US005467929A

United States Patent [19]

Bosio

[11] Patent Number: 5,467,929

[45] Date of Patent: Nov. 21, 1995

[54] AERATOR FOR LIQUIDS

[75] Inventor: Orlando Bosio, Casaloldo, Italy

[73] Assignee: AMFAG S.r.l., Castelgoffredo, Italy

[21] Appl. No.: 241,528

[22] Filed: May 12, 1994

[30] Foreign Application Priority Data

May 20, 1993 [IT] Italy ..... MN93U0015

[51] Int. Cl.[6] ..... E03C 1/084

[52] U.S. Cl. ..... 239/428.5; 261/DIG. 22

[58] Field of Search ..... 239/428.5, 432, 239/553.3, 553.5, 590.3, 590.5; 261/DIG. 22

[56] References Cited

U.S. PATENT DOCUMENTS

| | | | |
|---|---|---|---|
| 2,744,738 | 5/1956 | Hjulian | 239/428.5 |
| 2,787,452 | 4/1957 | Aghnides | 239/428.5 |
| 2,889,999 | 6/1959 | Tomlinson | 239/428.5 |
| 2,940,675 | 6/1960 | Robb | 239/428.5 |
| 3,010,659 | 11/1961 | Goodrie et al. | 239/428.5 |
| 4,403,739 | 9/1983 | Knapp et al. | 239/428.5 |
| 4,470,546 | 9/1984 | Wildfang | 239/428.5 |
| 4,530,467 | 7/1985 | Bueno | 239/428.5 |
| 4,534,513 | 8/1985 | Aghnides | 239/428.5 |
| 4,637,552 | 1/1987 | Finkbeiner et al. | 239/428.5 |
| 4,657,186 | 4/1987 | Shapiro . | |
| 5,242,119 | 9/1993 | Jariyasunant . | |

FOREIGN PATENT DOCUMENTS

| | | |
|---|---|---|
| 0284763 | 10/1988 | European Pat. Off. . |
| 625084 | 7/1949 | United Kingdom . |

*Primary Examiner*—Karen B. Merritt

*Attorney, Agent, or Firm*—Guido Modiano; Albert Josif

[57] ABSTRACT

The aerator has a body having openings formed therein and containing meshes and a perforated plate. A monolithic convex diaphragm, defining a wall, has holes formed in a central region thereof and is perimetrically ultrasonically welded to a seat formed in the plate. The convexity of the diaphragm is oriented in a fluid flow direction, whereby retained particles are collected at the base of the perimeter of the diaphragm.

2 Claims, 1 Drawing Sheet

AERATOR FOR LIQUIDS

BACKGROUND OF THE INVENTION

The present invention relates to an improved aerator for liquids.

It is known that so-called aerators are widely used, which are installed at the outlet of liquid conveyance ducts and particularly of ducts conveying water to sinks, with the specific purpose of breaking the stream of fluid into parallel threads so as to make the jet that exits into the atmosphere perfectly cylindrical.

Known aerators include, according to a very common embodiment, a body usually installed in a ring associatable with the end of the duct that conveys the liquid and suitable to contain various elements, such as a pack of metal meshes and a perforated plate. A filter is furthermore installed at the end of the body on the liquid inlet side. The filter has the purpose of retaining the impurities present in the liquid, and has the shape of a mesh that covers the entire cross-section of said body.

In order to limit the flow-rate of the liquid conveyed by the duct at the end of which the aerator is installed, so as to save on the consumption of said liquid, in the known art it is possible to place on said filter a cap which is kept in position by means of an appropriate gasket and has a solid wall with a central hole, so that the passage section of the liquid is reduced and the intended purpose is thereby achieved.

The resulting complicated configuration, however, is clearly disadvantageous in terms of costs and from a functional point of view, since reassembly problems can occur every time the user disassembles the ring containing the aerator to clean the aerator itself.

There are also aerators which have, at the end of the body containing the pack of meshes, a disk provided with a central hole for limiting the flow-rate, with the exclusion of any filtering action. However, impurities entrained by the liquid become trapped below said disk and cannot be removed in any way, causing rapid loss of efficiency of the device.

SUMMARY OF THE INVENTION

An aim of the present invention is therefore to provide an improved aerator for liquids which has an extremely simple structure and is suitable to filter the liquid effectively before it enters the aerator itself and at the same time limits the flow-rate of the conveyed liquid.

With this aim in view, the invention provides an improved aerator for liquids, which comprises a containment body, characterized in that it comprises a diaphragm arranged at the end of said body on the liquid inlet side and formed so as to have a solid wall which is only partially provided with liquid passage holes.

BRIEF DESCRIPTION OF THE DRAWINGS

Further characteristics and advantages of the present invention will become apparent from the following description thereof, illustrated only by way of non-limitative example in the accompanying drawings, wherein.

DESCRIPTION OF THE PREFERRED EMBODIMENTS

Figure 1:
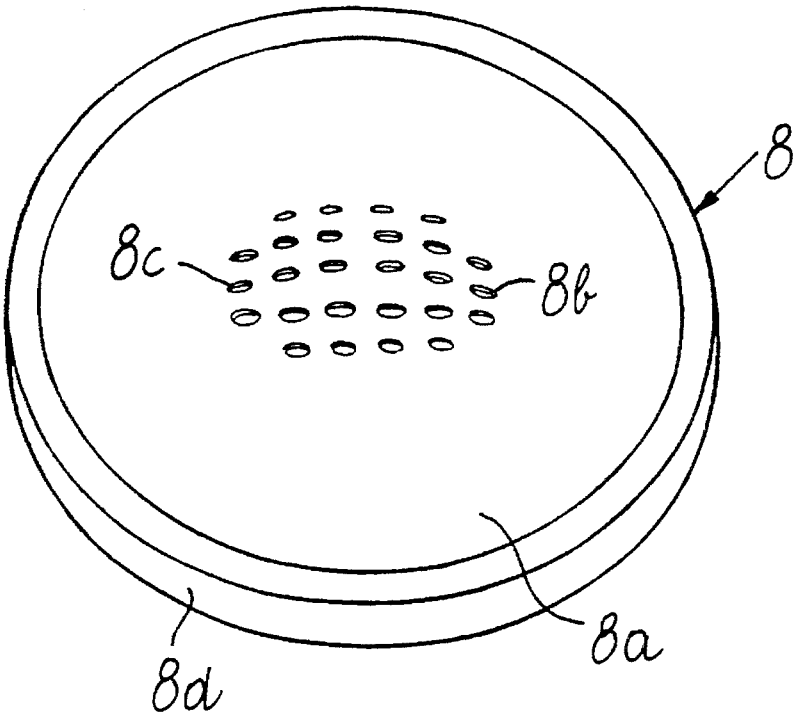
FIG. 1 is a perspective view of the diaphragm according to the invention.
Figure 2:
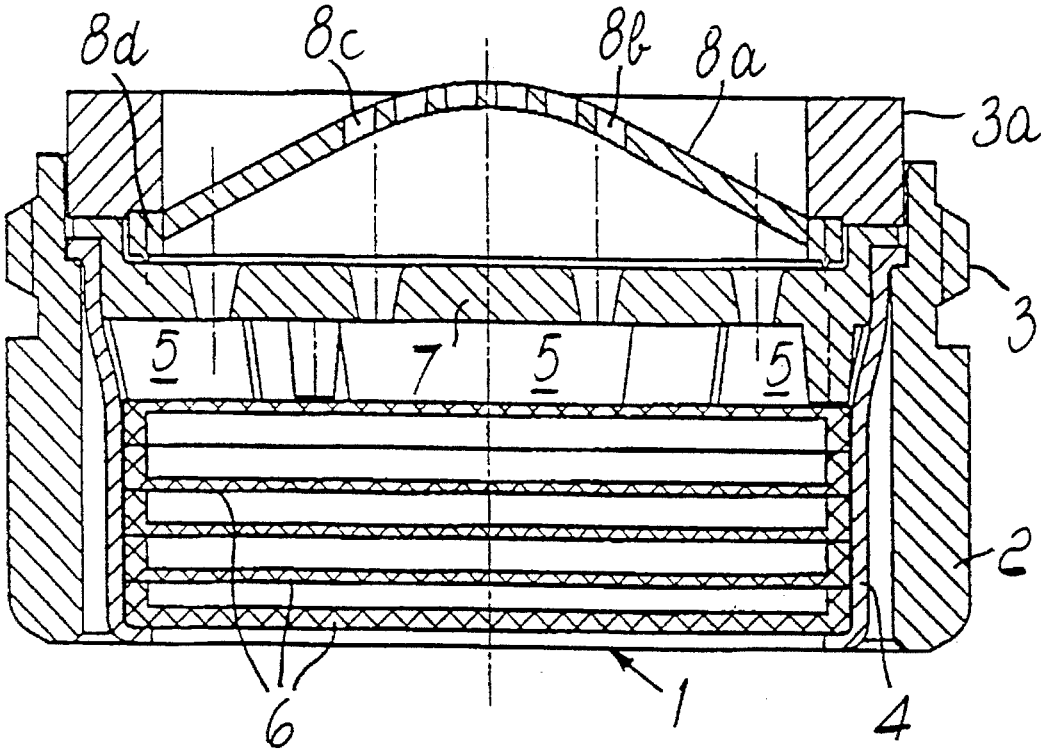
FIG. 2 is a sectional view, taken along a diametrical plane, of an aerator according to the invention inserted in a containment ring.

With reference to the above figures, the reference numeral 1 generally designates the aerator, which is installed within a ring 2 adapted to be screwed at the thread 3 to the end of a liquid conveyance duct, such as, very commonly, the duct conveying water to a sink, and the reference numeral 3*a* designates a sealing gasket.

Said aerator comprises a body 4, which has openings 5 and is suitable to contain meshes 6 and a perforated plate 7.

All this occurs in a known manner.

At the end of the body 4, on the side of the water inlet, there is a diaphragm 8, comprising a solid wall 8*a* which is convex toward the flow of fluid and has holes 8*b*, 8*c* for the passage of water exclusively in the central region and thus at the top of its convexity.

Advantageously, the diaphragm 8 is made of plastics, like the body 4 and the plate 7, and has a monolithic structure provided with a perimetric edge 8*d* that mates with a seat formed at the end of the body 4 and more specifically in the plate 7, so that the entire assembly can be rigidly coupled by ultrasonic welding.

The particular shape of the described diaphragm, which is placed at the end where the water enters the aerator body, gives said diaphragm considerable functionality.

First of all it has the purpose of retaining the impurities present in the liquid, preventing them from entering the body of the aerator: all the retained particles slide to the base of the convex wall and collect at its perimeter, thus allowing immediate cleaning once access to the body 4 has been allowed by simply unscrewing the ring 2 from the end of the liquid conveyance duct.

However, the functionality of the diaphragm according to the invention is not limited to this: in fact, by virtue of the reduction in the liquid passage section caused by the presence of the solid wall region 8*a* that has no holes, it is capable of limiting the flow-rate of liquid conveyed by the duct at the end of which it is installed, thus providing a positive effect of saving in operation.

To summarize, the diaphragm according to the invention combines the dual function of filter and flow limiter.

In the practical embodiment of the invention, all the liquid passage holes, which may be present in any number and have any shape, may be arranged exclusively in a peripheral region or at a median band or at sectors, instead of being located in the central region; furthermore, the wall of the diaphragm, instead of being convex toward the flow of the fluid, may be substantially flat.

I claim:

1. Aerator (1) for liquids, comprising a containment body (4) connectable to an end of a liquid conveyance duct, a perforated plate (7) contained within said body (4), a plurality of meshes (6) disposed within said body (4), and a diaphragm (8), said diaphragm comprising a solid wall (Sa) partially provided with liquid passage holes (8*b*, 8*c*), said diaphragm being seated on said plate (7) on a part of said body (4) connectable to an end of a liquid conveyance duct, wherein said liquid passage holes (8*b*, 8*c*) are present only on a middle portion of said solid wall (8*a*).

2. In combination, a liquid conveyance duct having an end, an aerator (1), and means (2, 3) for connecting said aerator (1) to said end of said liquid conveyance duct, wherein said aerator comprises;

a tubular body (4) defining a liquid inlet;

a plurality of spaced-apart superimposed meshes (6) contained within said body (4);

a perforated plate (7) contained within said body (4) between said liquid inlet and said plurality of spaced-apart superimposed meshes (6);

a plurality of openings (5) formed in said body (4) between said plurality of spaced-apart superimposed meshes (6) and said perforated plate (7);

a convex diaphragm (8) peripherally engaging said perforated plate (7) and;

a sealing gasket (3*a*) having one face in abutment engagement with said perforated plate (7) and a peripheral portion of said convex diaphragm;

wherein said convex diaphragm (8) comprises a solid wall (8*a*), said solid wall (8*a*) having formed in a portion thereof a plurality of holes (8*b*, 8*c*), said convex diaphragm (8) having a convexity extending away from said perforated plate (7);

and wherein said portion of said solid wall (8*a*) having formed therein said plurality of holes (8*b*, 8*c*) is located on a central portion of said convex diaphragm (8) disposed furthermost from said perforated plate (7), whereby to filter and accumulate particulate impurities contained in liquid at a periphery of said convex diaphragm (8) and thereby prevent clogging of said plurality of holes (8*b*, 8*c*).

* * * * *